US006378248B1

(12) United States Patent
Jordal

(10) Patent No.: US 6,378,248 B1
(45) Date of Patent: Apr. 30, 2002

(54) DUAL PANEL JALOUSIE ASSEMBLY WITH INDEPENDENT PANEL MOVEMENT

(76) Inventor: Robert L. Jordal, 147 Farmbrooke La., Winston-Salem, NC (US) 27127

( * ) Notice: Subject to any disclaimer, the term of this patent is extended or adjusted under 35 U.S.C. 154(b) by 0 days.

(21) Appl. No.: 09/668,065

(22) Filed: Sep. 25, 2000

(51) Int. Cl.[7] ..... E06B 7/094; E06B 7/084

(52) U.S. Cl. ..... 49/80.1; 49/73.1; 49/64; 49/98

(58) Field of Search ..... 49/73.1, 77.1, 49/80.1, 63, 64, 68, 98, 104, 61

(56) References Cited

U.S. PATENT DOCUMENTS

| | | | | | |
|---|---|---|---|---|---|
| 270,832 | A | * | 1/1883 | Nolan | 49/51 |
| 335,354 | A | * | 2/1886 | Hayes | 49/58 |
| 345,689 | A | * | 7/1886 | Hayes | 49/58 |
| 345,690 | A | * | 7/1886 | Hayes | 49/64 |
| 345,691 | A | * | 7/1886 | Hayes | 49/64 |
| 345,692 | A | * | 7/1886 | Hayes | 49/64 |
| 345,693 | A | * | 7/1886 | Hayes | 49/58 |
| 1,319,902 | A | * | 10/1919 | Richard | 296/96.18 |
| 2,366,339 | A | * | 1/1945 | Kump | 49/77.1 |
| 2,561,846 | A | * | 7/1951 | Curry | 160/91 |
| 2,607,452 | A | * | 8/1952 | Hall | 49/77.1 |
| 2,758,345 | A | * | 8/1956 | White | 49/64 |
| 2,867,861 | A | * | 1/1959 | Pilson | 49/64 |
| 3,120,035 | A | * | 2/1964 | Morris | 49/77.1 |
| 3,468,058 | A | * | 9/1969 | Fontaine | 49/74.1 |
| 3,991,518 | A | * | 11/1976 | Ishihara | 49/74.1 |
| 4,254,581 | A | * | 3/1981 | Ishihara | 49/82.1 |
| 4,855,716 | A | | 8/1989 | Jordal | |
| 5,490,353 | A | * | 2/1996 | McLaughlin | 49/64 |
| 6,098,339 | A | * | 8/2000 | Rivera et al. | 49/74.1 |

* cited by examiner

*Primary Examiner*—Gregory J. Strimbu

(57) ABSTRACT

A jalousie assembly comprising a plurality of independently adjustable front and rear panels forming tandem pairs. A front panel operator operates the front panels and a rear panel operator operates the rear panels independently from the front panels. Thus, the front panels can be opened independently from the rear panels or together with the rear panels. The front panel may be constructed of aluminum or glass while the rear panel may be constructed of transparent glass.

13 Claims, 6 Drawing Sheets

DUAL PANEL JALOUSIE ASSEMBLY WITH INDEPENDENT PANEL MOVEMENT

FIELD OF THE INVENTION

The invention herein pertains to jalousie assemblies as are used for building windows and doors and particularly pertains to a jalousie assembly having pairs of pivotable panels which are tandemly arranged and independently operated.

DESCRIPTION OF THE PRIOR ART AND OBJECTIVES OF THE INVENTION

Jalousie type windows and doors have long been used and remain quite popular in tropical climates. The advantages of such jalousie assemblies is that the horizontal panels can be selectively opened and closed to allow breezes for example, from the ocean to ventilate and cool the building without the necessity of air conditioning. This is of particular importance in areas where electricity is extremely expensive or unavailable. Jalousie assemblies generally have one vertical column of panels with each panel formed of a relatively narrow, single glass pane. A typical window may have three or four such panes arranged in this vertical column. The panels are operated by a handle and gears which are manually rotated to open or close the panels as required.

In recent years improvements have been developed such as shown in my earlier U.S. Pat. No. 4,855,716 which provides an awning or jalousie type security window having dual panes of glass which are rigidly connected and operate as a single panel.

Even though such dual pane jalousie panels provide increased strength and protection, various disadvantages remain. For example, the panel must be completely transparent in order for the user to see through the window when it is closed. In addition, the amount of ventilation received through the window is related to the single panel opening. Also, typical awning or jalousie windows that face the sun require curtains or blinds to shade the window during bright, sunny days.

In view of the disadvantages and problems associated with conventional jalousie type windows and doors, the present invention was conceived and one of its objectives is to provide a jalousie assembly which can be used in either windows or doors and includes pairs of tandemly positioned panels in which the front and rear panels can be operated (rotated) independently.

It is still another objective of the present invention to provide a jalousie assembly in which tandem panels can be formed from different materials.

It is yet another objective of the present invention to provide a jalousie assembly in which the amount of ventilation can be precisely regulated by the independently operated front and rear panels.

It is still another objective of the present invention to provide a jalousie assembly which includes a pair of operators for independent adjustment of the front and rear panels.

Various other objectives and advantages of the present invention will become apparent to those skilled in the art as a more detailed description is set forth below.

SUMMARY OF THE INVENTION

The aforesaid and other objectives are realized by providing a jalousie assembly which includes tandemly arranged panels. A tandem pair includes a front panel and a rear panel with, in the preferred embodiment, the front panel constructed of an opaque material such as aluminum and the rear panel formed of glass. The jalousie assembly may be used in, for example, a window having a single column of several panel pairs. One, two, three or more panel pairs may be vertically aligned with the panels being selectively sized. The jalousie assembly could also be used in doors with eight, ten or more panel pairs, vertically aligned, with said door panels usually shorter than panels used in windows.

A mechanical operator allows all the front panels to be pivoted simultaneously, whereas a second operator with handle will pivot the rear panels simultaneously. Thus, in cold weather the front opaque panels can be fully opened to allow sunlight into a building with the rear transparent panels closed to maintain a comfortable interior temperature.

Each pair of front and rear panels are operated from a central axle composed of staggered, axially aligned front and rear panel axle sections. Thus, as one operator is turned the axle sections connected to one panel are rotated while the axle sections of the other panel remain dormant until the second operator connected thereto is rotated. A contiguous cylindrical support shaft passes through the center of the axle sections of the tandem pair of panels to maintain the axle sections in axial alignment.

DETAILED DESCRIPTION OF THE PREFERRED EMBODIMENT AND OPERATION OF THE INVENTION

Figure 1:
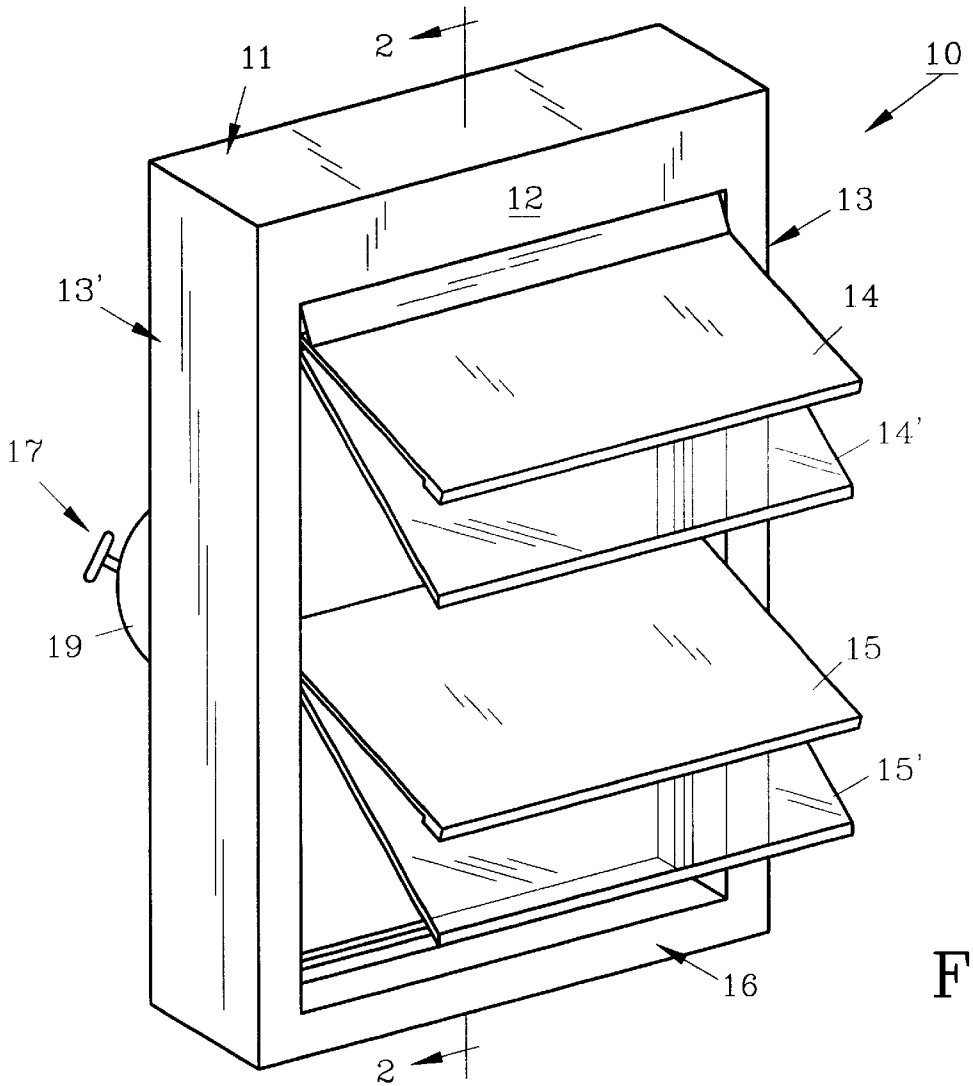
FIG. 1 illustrates a perspective view of the preferred jalousie assembly of the invention as used in a window.

For a better understanding of the invention and its operation, turning now to the drawings, FIG. 1 demonstrates the preferred jalousie assembly 10 used in a conventional jalousie or awning window which includes frame 11 with header 12, jambs 13, 13' and sill 16. Tandem panel pairs 14, 14' and 15, 15' are pivotally joined to window frame 11. As shown front panels 14 and 15 are opaque, being formed of aluminum or other suitable materials. Rear panels 14' and 15' are glass as are usual in jalousie type windows and doors. As will be hereinafter explained in more detail, front panels 14 and 15 are independently operated from rear panels 14' and 15' and can be opened and closed as required. Front aluminum panels 14 and 15 are simultaneously operated by handle 17 of standard operator 19 whereas rear glass panels 14' and 15' are operated by handle 18 (FIGS. 11 and 12) positioned on jamb 13. While only two pairs of aluminum and glass panels are shown in FIG. 1, similar jalousie assemblies could be constructed utilizing three, four or even more tandem pairs. It is not unusual for jalousie assemblies as used in doors to have six or more pivotable panels.

Figure 2:
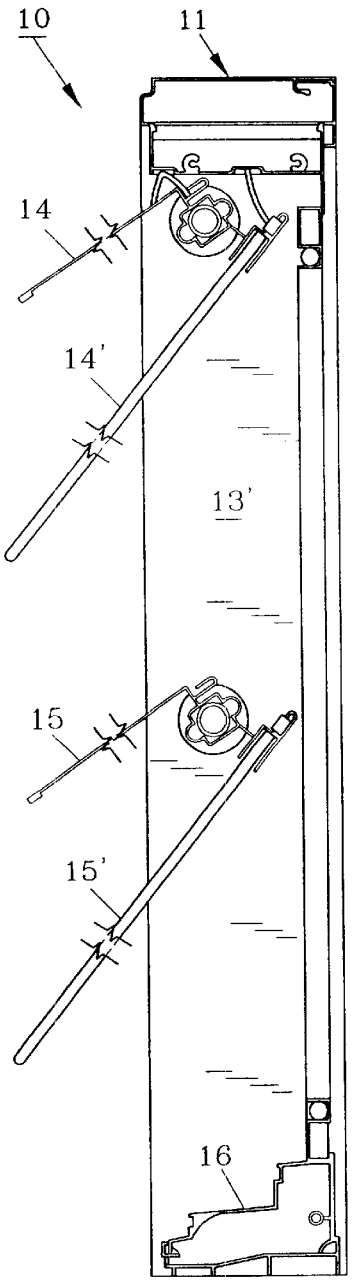
FIG. 2 shows a side elevational view of the jalousie assembly as shown in FIG. 1 along lines 2—2 with both the front and rear panels opened.
Figure 3:
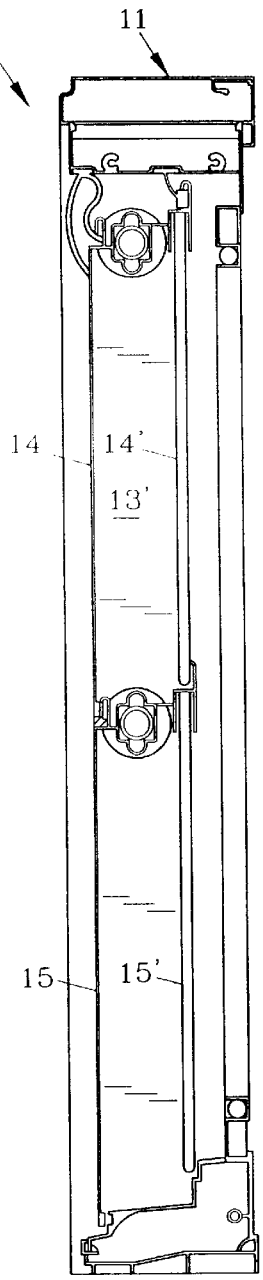
FIG. 3 features the jalousie assembly of FIG. 2 with both pairs of panels closed.
Figure 4:
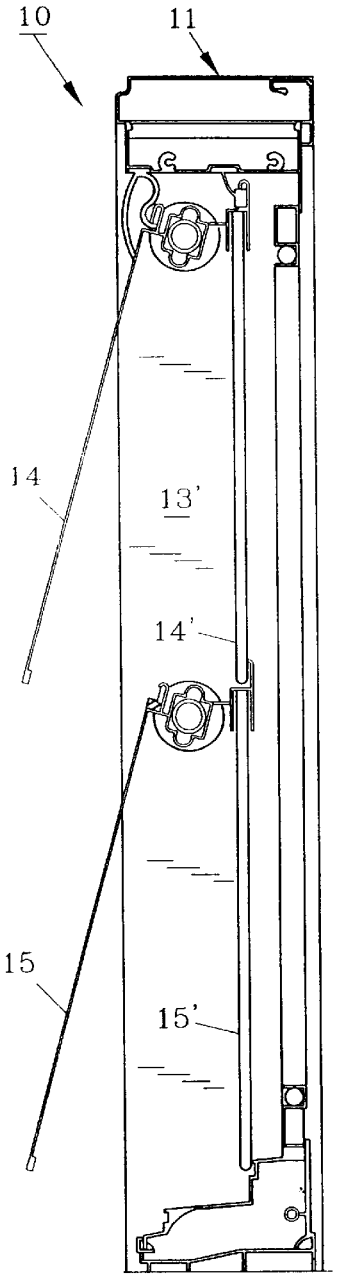
FIG. 4 demonstrates the jalousie assembly of FIG. 1 with the rear panels closed and the front panels opened.

Preferred jalousie assembly 10 as shown in FIGS. 2–4 demonstrates the versatility of the independently operated front and rear panels. For example, in FIG. 2 panels 14, 14' 15, 15' are opened to allow ventilation into the building. Opaque aluminum panels 14, 15 provide shade when opened to glass panels 14', 15' during periods of direct sunlight. In FIG. 3 panels 14, 14', 15, 15' are all closed as would be required during severe storms. In FIG. 4 front panels 14 and 15 are open, whereas rear glass panels 14' and 15' are closed. During cold weather conditions, panels 14 and 15 can be fully opened to allow light to pass into the building, whereas rear panels 14' and 15' can remain closed to retain heat.

Figure 5:
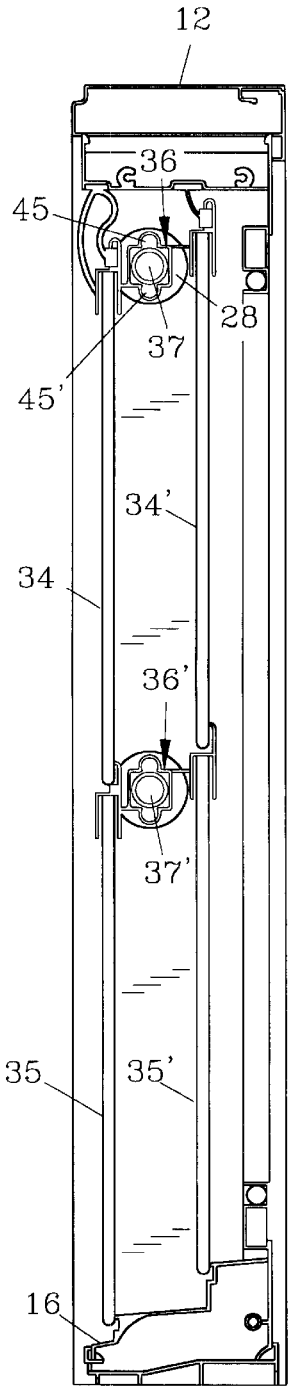
FIG. 5 depicts another embodiment of the jalousie assembly as shown in FIG. 1 with both pairs of glass panels closed.
Figure 6:
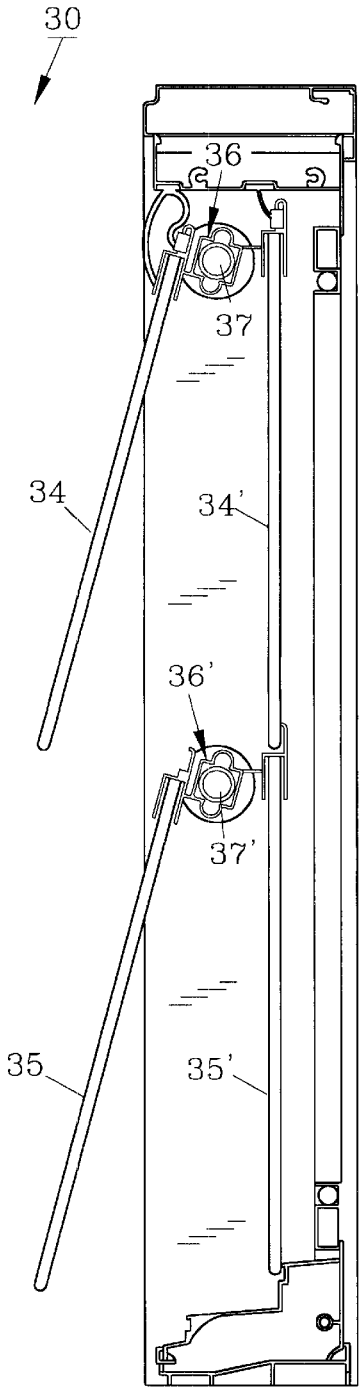
FIG. 6 shows the jalousie assembly of FIG. 5 with the front panels open.
Figure 7:
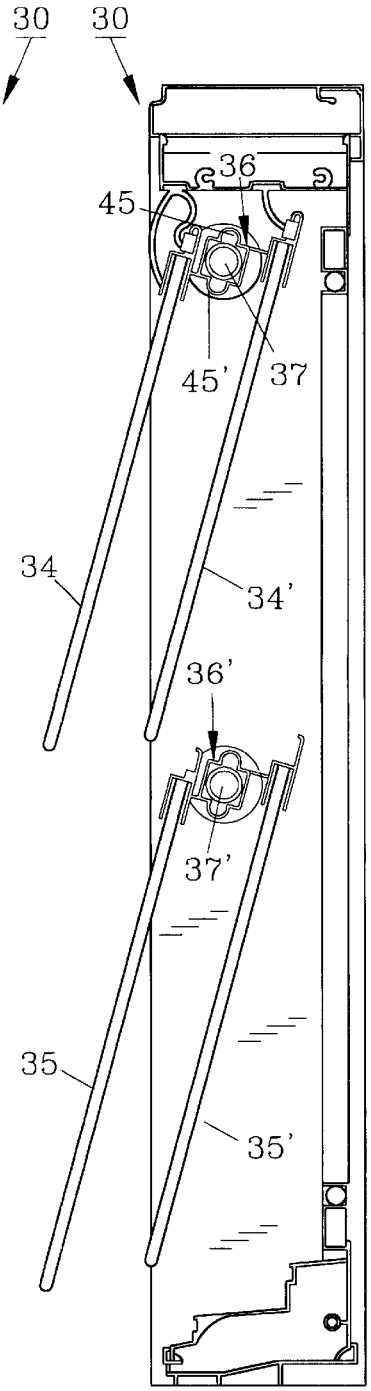
FIG. 7 pictures the jalousie assembly as shown in FIG. 5 with both the front and rear panels open.

In an alternate embodiment of the jalousie assembly, FIGS. 5, 6 and 7 demonstrate jalousie assembly 30 which is similar to jalousie assembly 10 of FIG. 1 with the exception of utilizing glass front panels 34, 35. As seen in FIG. 5, jalousie assembly 30 includes rear glass panels 34' and 35'. FIG. 6 demonstrates jalousie assembly 30 with front glass panels 34, 35 opened and with the rear glass panels 34', 35' closed. FIG. 7 depicts jalousie assembly 30 with both front glass panels 34, 35 and rear glass panels 34', 35' in an open posture. As shown, glass panels 34, 34' are in tandem, as are glass panels 35, 35'. Also, front glass panels 34, 35 operate independently of rear panels 34', 35' as earlier described.

Figure 8:
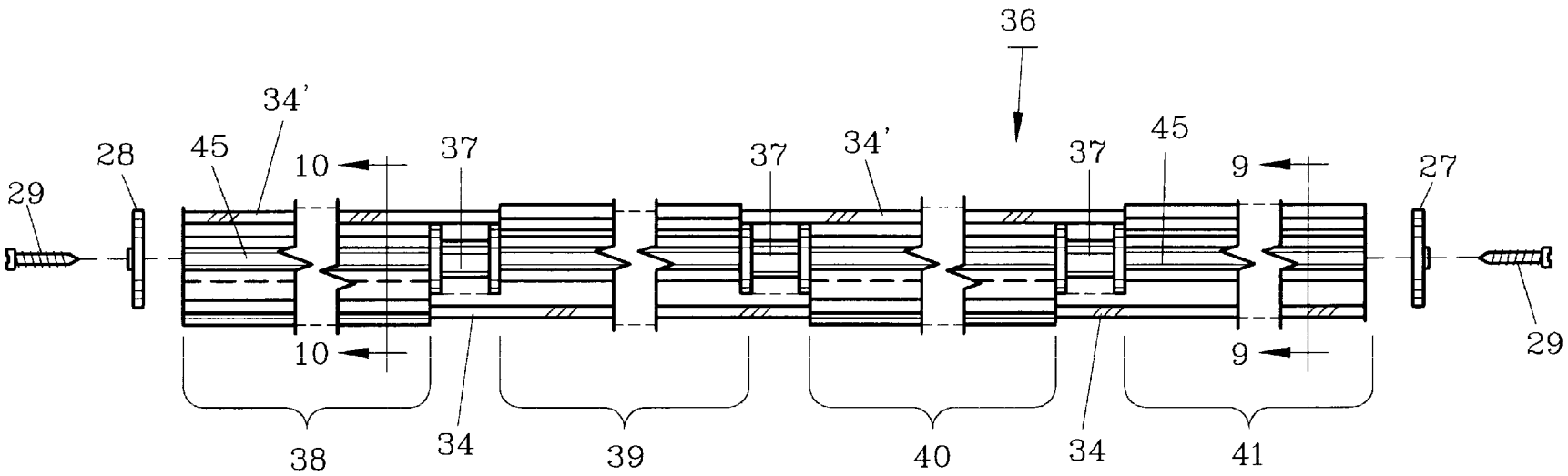
FIG. 8 depicts a fragmented exploded top view of a cylindrical shaft and central axle as for a tandem pair of panels.
Figure 10:
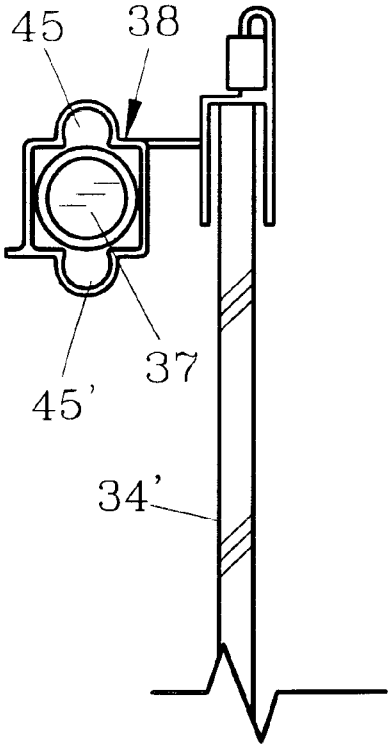
FIG. 10 presents a portion of the central shaft as seen along lines 10—10 of FIG. 8.
Figure 9:
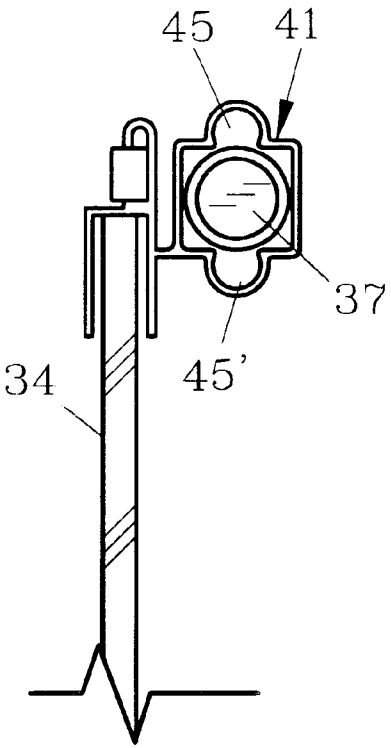
FIG. 9 features a portion of the central shaft along lines 9—9 as seen in FIG. 8.
Figure 11:
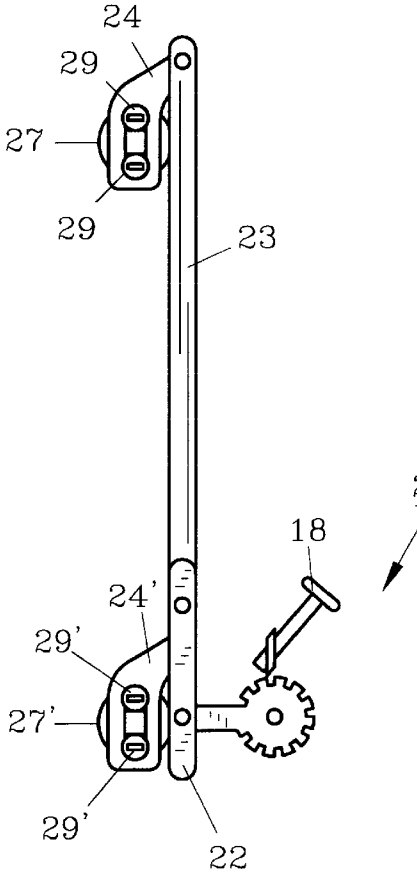
FIG. 11 illustrates a schematic operator of the invention attached to panel linkages.

As further seen in FIG. 5, panels 34, 34' are joined to a central rectangular axle 36 and panels 35 and 35' are joined to rectangular axle 36'. As seen in FIG. 8, axle 36 is formed of extruded rectangularly shaped aluminum axle sections 38, 39, 40 and 41. In FIG. 8, rectangular axle 36 includes a series of four individual axle sections, 38, 39, 40 and 41 with axial alignment support by cylindrical shaft 37 passing therethrough. Shaft 37 is not joined to axle section 38, 39, 40, 41 but is sized to allow rotation therearound. A cylindrical shaft 37' is disposed within rectangular axle 36'. Thus, operator 20 as shown in FIG. 11 with handle 18 will operate sections 38 and 40 of central axle 36 which are connected to front panel 34, whereas another operator (not shown in FIG. 11) will operate axle sections 39 and 41 in the same manner to rotate rear panel 34'. Axle sections 38, 40 retain glass panel 34 as shown in FIG. 8 whereas axle sections 39 and 41 retain rear glass panel 34'. FIGS. 9 and 10 show an enlarged view of axle sections 41 and 38 with glass panels 34 and 34' respectively.

Figure 12:
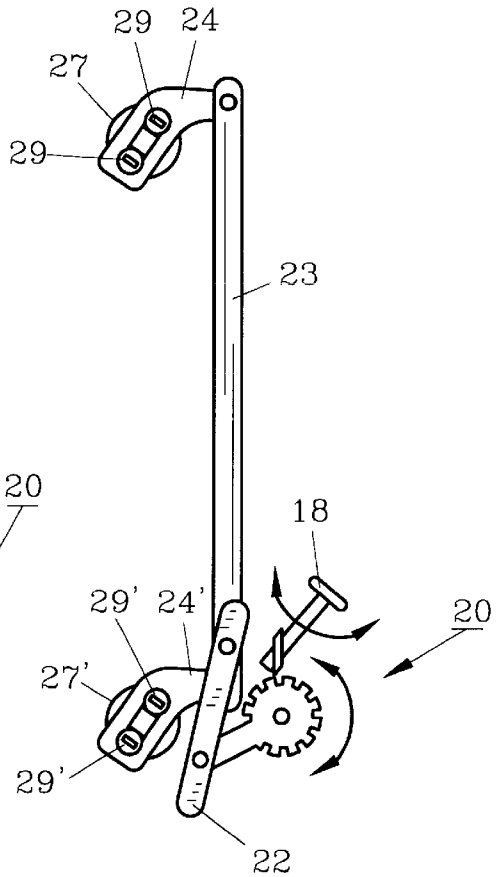
FIG. 12 shows the operator and linkages of FIG. 11 in a rotated posture.

In use, standard operator 20 is joined to linkage 22 as shown in FIGS. 11 and 12. When handle 18 is rotated to a more downward position as shown in FIG. 12, linkage 23 is pulled downwardly, causing cranks 24, 24' to rotate in a clockwise direction. Cranks 24, 24' are each joined to respectively, bearings 27, 27' by threaded members 29, 29' in, for example, jamb 13. Threaded member 29 passes through bearing 27 and into channels 45 and 45' of axle section 41 as shown in FIGS. 5, 8 and 11. Another threaded member 29 passes through bearing 28 on the opposite end of central axle 36. Thus, as handle 18 is turned, axle sections 39, 41 rotate driving rear panel 34'. Likewise, crank 24' is simultaneously turned with crank 24 and panel 35' (FIG. 5) is also driven therewith.

Likewise, if the other handle and operator (not seen) connected to jalousie assembly 30 is rotated, shaft sections 38, 40 are turned, driving front panels 34 and 35 simultaneously.

Figure 13:
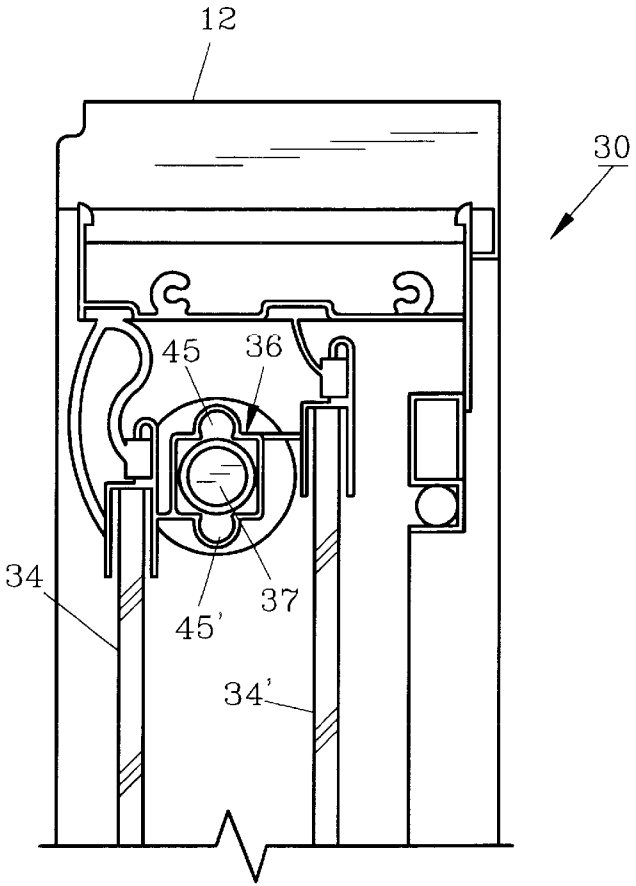
FIG. 13 pictures an enlarged fragmented top portion of the jalousie assembly as seen in FIG. 5.

FIG. 13 shows an enlarged side elevational view of the top of the jalousie assembly 30 as shown in FIG. 5. As it would be understood, certain seals and gaskets have been eliminated for clarity and are not part of the present invention but would be incorporated as is usual in the jalousie window trade.

The illustrations and examples provided herein are for explanatory purposes and are not intended to limit the scope of the appended claims.

I claim:

1. A jalousie assembly comprising: a frame, a pair of independently pivotable front and rear panels, said front and rear panels positioned within said frame, a central axle, said central axle comprising a front panel axle section and a rear panel axle section, said front panel axle section joined to said front panel, said rear panel axle section joined to said rear panel, said front and rear panel axle sections being axially staggered along said central axle, a pair of operators, each of said pair of operators connected to a respective one of said panel axle sections to independently drive the same.

2. The jalousie assembly of claim 1 wherein said front and rear panels are opposingly positioned with said central axle disposed therebetween.

3. The jalousie assembly of claim 2 wherein said central axle is cylindrically shaped.

4. The jalousie assembly of claim 1 further comprising a shaft, said shaft for receiving said central axle.

5. The jalousie assembly of claim 1 wherein one of said panels is formed of glass.

6. The jalousie assembly of claim 1 wherein one of said panels is opaque.

7. The jalousie assembly of claim 1 wherein each of said pair of panels is formed of glass.

8. The jalousie assembly of claim 1 wherein said frame is extruded aluminum.

9. The jalousie assembly of claim 1 wherein each of said axle sections is rectangularly shaped.

10. A jalousie assembly comprising: a frame, independently pivotable front and rear panels, said front and rear panels positioned within said frame, a front panel axle, a rear panel axle, a shaft, said front and rear panel axles axially aligned in a staggered relation along said shaft, said front panel axle attached to said front panel, said rear panel axle attached to said rear panel, a pair of operators, each of said operators connected to a respective one of said panel axles for independently driving the same.

11. The jalousie assembly of claim 10 comprising a shaft wherein said shaft extends through said front and rear panel axles.

12. The jalousie assembly of claim 10 wherein each of said panel axles is rectangularly shaped.

13. The jalousie assembly of claim 12 wherein said panel axles are extruded aluminum.

* * * * *